340-567 SR

XR 4,038,633

United State

King

1] 4,038,633

5] July 26, 1977

[54] DETECTION SYSTEM FOR AUTOMOBILES AND OTHER MOTOR-DRIVEN OBJECTS

[76] Inventor: Frederick N. King, 5068 Franklin Ave., Los Angeles, Calif. 90027

[21] Appl. No.: 569,708

[22] Filed: Apr. 21, 1975

Related U.S. Application Data

[63] Continuation of Ser. No. 390,364, Aug. 22, 1973.

[51] Int. Cl.[2] ..... G08G 1/00

[52] U.S. Cl. ..... 340/38 L; 340/258 C

[58] Field of Search ..... 340/38 L, 51

[56] References Cited

U.S. PATENT DOCUMENTS

| | | | |
|---|---|---|---|
| 2,450,166 | 9/1948 | Rich | 340/38 L |
| 3,634,843 | 1/1972 | Corris | 340/38 L |

*Primary Examiner*—Thomas B. Habecker

*Attorney, Agent, or Firm*—Roger A. Marrs

[57] ABSTRACT

A system for detecting the presence of motor-driven vehicles or other objects which are motor-driven includes a sensor for detecting the presence of a changing magnetic field generated by operation of a rotational electrical device, such as an alternator, a generator, or a magneto contained in the electrical system of and driven by the motor of the object being sensed. The sensor includes a coil wound on a ferromagnetic core and connected to a suitable amplifier and output device. Electrical current is induced to flow in the coil as long as a motor-driven object containing an operative rotational electrical device is in close proximity to the coil. The output device is energized in response to the continuous flow of induced electrical current in the coil to provide a continuous output indicating that the presence of the motor-driven object is being detected.

12 Claims, 7 Drawing Figures

DETECTION SYSTEM FOR AUTOMOBILES AND OTHER MOTOR-DRIVEN OBJECTS

This application is a continuation of and co-pending with U.S. application for Letters Patent entitled Detection System For Automobiles and Other Motor-Driven Objects filed Aug. 22, 1973, having Ser. No. 390,364.

BACKGROUND OF THE INVENTION

1. Field of the Invention

This invention relates to devices for detecting the presence of motor-driven objects, and in its preferred embodiment relates to a system for detecting the presence of motor vehicles for use in controlling vehicle traffic.

2. Description of the Prior Art

In the past, a variety of vehicle detectors have been used to monitor the flow of traffic and control traffic signals in response to the traffic flow. One type of vehicle detector is the so-called "pulse detector" which senses the passage of a vehicle moving past a sensor and generates a pulse for each vehicle sensed. The pulse is fed to a suitable control circuit for either counting the vehicles or activating a traffic signal controller, for example. The main disadvantage of pulse detectors is that a vehicle must be in motion before it can be sensed by the detector. A vehicle stopping in the vicinity of the sensor is not sensed continuously while it is in the presence of the sensor. Thus, when the vehicle departs from the vicinity of the sensor, no instruction is provided by the sensor to the control circuit to indicate that the vehicle is no longer present. Accordingly, pulse-type detectors are not particularly suitable for traffic signal control where it is desired to continuously know whether a vehicle is present at a signal. For example, pulse detectors will instruct a traffic signal controller that a certain number of vehicles have passed a certain detection point. However, since they do not monitor the continuous presence of vehicles which may be standing idle waiting for a signal to change, they are unable to instruct a signal controller to change the signal once all the vehicles have left the detection point.

Another major type of vehicle detector is the so-called "presence detector" which senses vehicular traffic whether or not the vehicles are in motion and is able to provide a continuous signal to a control circuit as long as the vehicle being sensed in in the vicinity of the presence detector. The most common type of vehicle presence detector used today is the so-called "inductive loop" detector in which a large inductive loop formed by a coil comprising two or three turns of a relatively large diameter conductor wire (preferably No. 12 wire) is embedded in a traffic lane. The inductive loop is part of a tuned circuit for controlling the frequency of an oscillator. A vehicle entering the field of the loop will vary the inductance value of the loop and thereby change the loop circuit resonant frequency characteristics. This is sensed to provide an output signal which is fed to a traffic controller for controlling a set of traffic signals.

There are several disadvantages of the inductive loop vehicle-presence detectors. For example, inductive loop detectors basically are "metal detectors," since the presence of a relatively large metallic object in the magnetic field of the inductive loop is necessary to detune the loop circuit to indicate the presence of the object. Relatively large metal masses such as automobiles, trucks, and buses are easily detected magnetically, but unfortunately smaller objects such as motorcycles often are not detected. Moreover, extremely large metallic objects, such as a bus or a large truck passing in a given lane of traffic may be detected by sensors located in two adjacent traffic lanes and therefore counted as two passing vehicles rather than one. Large stationary metallic masses, such as a nearby parked automobile, often will be continuously sensed by the inductive loop which then locks up the operation of the detector circuit, and thereby interferes with the proper operation of the traffic signal controller.

The detector circuit of inductive loop detectors generally operates in the RF (radio frequency) band in the range of about 100 KC. Operating on radio frequencies limits the effective cable length between the inductive loop pickup and the output amplifier because of the combined added capacitance, resistance, and inductance of the electrical line carrying signals at these frequencies. Besides the sensitivity to cable length, radio frequency operation also makes the inductive loop detectors sensitive to environmental changes and cross-talk between adjacent pickup loops and lead-in wires.

The typical inductive loop is about a 6-foot square coil which requires removal of a substantial amount of pavement to embed the loop in a traffic lane. This results in a relatively high installation cost for the unit. The initial cost of inductive loop detector systems also is relatively high because of the use of rather sophisticated tuned oscillator circuits and related circuitry in the detector.

SUMMARY OF THE INVENTION

This invention provides a detection system which overcomes the disadvantages of pulse detectors and inductive loop presence detectors.

Briefly, the detection system provided by this invention includes a sensor or probe for sensing the presence of a changing magnetic field generated by operation of a rotational electrical device contained in the electrical system of and driven by the motor of a motor-driven object such as an automobile. The sensor includes a coil in which electrical current will be induced to continuously flow when a motor-driven object containing an operative rotational electrical device is in close proximity to the coil. The coil is suitably arranged in an electrical circuit which will induce current flow in the circuit independently of whether the motor-driven object being sensed is in motion. The coil and electrical circuit activate an output device which is operative in response to the flow of induced electrical current in the coil for providing a continuous output indicating that the presence of the motor-driven object is being sensed.

In a preferred form of the invention, the coil senses alternating magnetic fields within a frequency range of about 90 Hz to about 6,000 Hz. Preferably, the coil is operative to sense magnetic fields operating in this low frequency range by its design and construction and by means of a shield surrounding the coil to shield it against undesirable radio frequency signal pickup.

Thus, since the detection device of this invention is operative at low frequencies and is not a part of a tuned oscillator circuit, the problems of sensitivity to cable length between the sensor and control circuit, and sensitivity to environmental changes and the like, are eliminated. A major advantage of the detector is its ability to sense magnetic fields generated by the operation of rotational electrical devices, such as alternators, generators, or magnetos which are part of the electrical system used on all motor vehicles travelling on streets and highways. Thus, the detector of this invention is able to detect the presence of small motorcycles in addition to automobiles, trucks, and buses, since all of these vehicles have an alternator, a generator or a magneto which is in operation when the motor of the vehicle is running. Preferably, the coil of the detector system is part of an electrical circuit in which induced current in the coil provides a continuous output to an appropriate control circuit, such as a traffic signal controller, as long as a motor-driven object with its motor operating is present in the vicinity of the sensor. Thus, the detector of this invention has the advantage over pulse-type detectors of being able to provide a continuous output as long as the motor-driven object being sensed is in the presence of the sensor.

As a further advantage, the detector will not be rendered inoperative by the presence of nearby parked automobiles or other large metallic masses not having an engine which is running. The sensor and its associated low frequency control circuitry also is relatively simple in construction as compared to those with tuned oscillator circuits and related circuitry. Moreover, installation costs are reduced because the sensor of this invention is relatively small in size and thereby requires a relatively low installation cost to put it into use.

These and other aspects of the invention will be more fully understood by referring to the following detailed description and the accompanying drawings.

DESCRIPTION OF THE PREFERRED EMBODIMENT

The present invention discloses a detection system for sensing the presence of motor-driven objects. The invention will be described in the context of a vehicle presence detector for traffic signal controllers, although it will become clear from the following description that the invention has many other applications.

Figure 1:
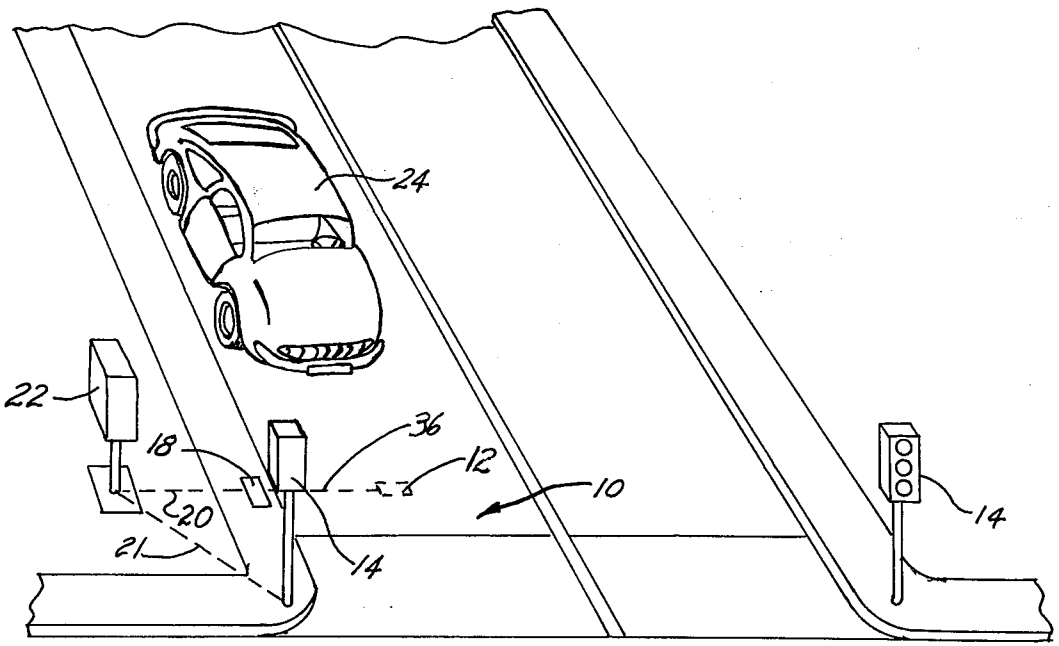
FIG. 1 is a schematic perspective view showing the detection device of this invention used in a traffic signal control system.

Referring to FIG. 1, a traffic signal control system 10 includes a magnetic field sensor 12 located at a detection point of a traffic lane in which vehicle traffic is controlled by traffic signals 14. Sensor 12 preferably is embedded in the roadbed, preferably by forming a relatively small sawcut in the pavement and embedding the sensor in an epoxy resin-base bonding material. The sensor need not be flush with the surface of the roadbed, but can be operative while embedded under several inches of the molded plastic resin which embeds it in the pavement. As an alternative, in instances where the sensor is used at detection points where it is not advisable to form a sawcut in the roadbed, such as on a bridge, the sensor can be placed on the road surface by embedding it in a standard lane marker. This is made possible by the fact that the sensor is about $3\frac{1}{4}$ inches long by $\frac{3}{4}$ inch wide by $\frac{1}{4}$ inch thick, making it relatively easy to install in pavement or on the pavement surface. This provides a clear advantage over inductive loops which are as much as 6 feet square and require a relatively large sawcut in the pavement when being installed, and which cannot be installed above surface level in any known practical manner.

Figure 3:
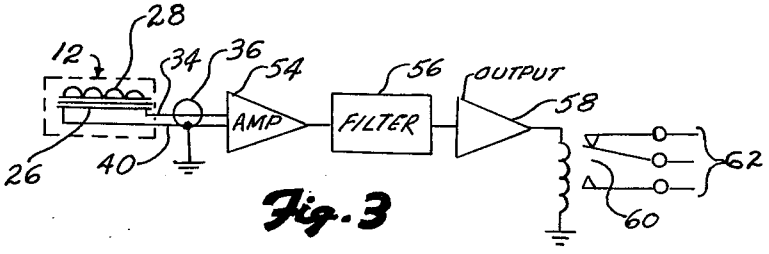
FIG. 3 is a schematic electrical block diagram showing the sensor connected to a system for indicating when the presence of a motor-driven object is detected.

Sensor 12, buried beneach the roadway surface, is connected to a shielded cable 36 which is preferably embedded in the roadbed and runs to a junction box 18 in the sidewalk. An underground conduit 20 carrying shielded cable 36 and other conductors connects junction box 18 to a pedestal mounted traffic signal controller cabinet 22 where the vehicle detector electronic package 54, 56, 58 60 and 62 FIG. 3 is stored along with the traffic signal controller and registers a call in the traffic signal controller while a vehicle is over sensor 12. A network of underground conduits 21 FIG. 1, and other conduits not shown, carrying conductors that connect the output of the traffic signal controller to the traffic signals providing means of actuating the signals when a vehicle such as 24 travels past or is stopped in the vicinity of sensor 12.

Figure 2:
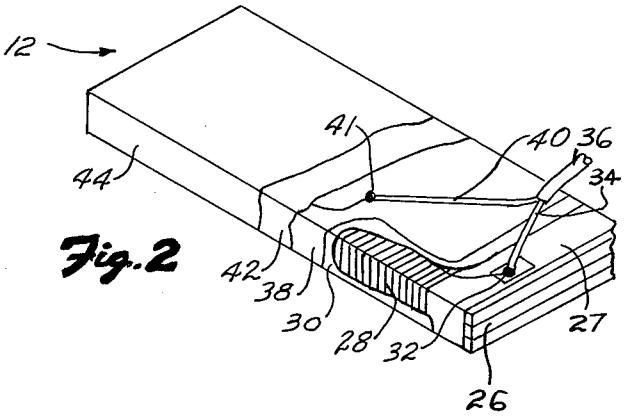
FIG. 2 is a fragmentary perspective view, partly broken away, showing a preferred embodiment of the magnetic field sensor of this invention.

The detailed construction of sensor 12 is understood best by referring to FIG. 2. The sensor includes a laminated ferromagnetic core 26, preferably three laminations about 0.018 inch thick each, of a ferromagnetic material such as soft iron. A layer 27 of insulating material such as paper covers a major portion of the core. A coil 28 of insulated wire is wound around core 26 and layer 27 leaving $\frac{1}{2}$ inch of core material extending beyond the coil at each end. Preferably, the coil consists of about 700 to 1,000 turns of No. 48 copper coil wire. A layer 30 of transformer-type insulating paper is wrapped around the coil and the ferromagnetic core. One end of the coil protrudes through the paper layer and is soldered to a copper solder tab 32 which is glued to the insulating paper and is thereby insulated from the other end of the coil and the core. A center conductor 34 of a shielded cable 36 also is connected to solder tab 32. A layer of copper foil 38 covers the layer 30 of insulating paper. The layer of copper foil provides a solder base for sheathing 40 of the shielded cable and the opposite end of coil wire 28, both being mutually soldered to copper foil layer 38 at 41. A layer 42 of thin aluminum foil completely encloses copper foil 38 and the remaining components of the sensor. Insulating tape (now shown) placed over tab 32 insulates it from the aluminum foil shielding. An outer layer 44 of insulating tape is wrapped on top of the layer of aluminum foil to completely enclose the sensor.

Figure 4:
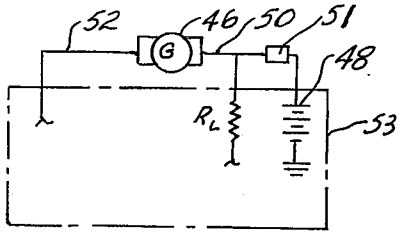
FIG. 4 is a schematic electrical diagram illustrating the electrical system of an automobile which generates an alternating magnetic field.

The main purpose of copper foil layer 38 and the layers 42 of aluminum foil is to shield the sensor against pickup of radio frequency energy, such as that which can be generated by the spark from spark plugs in the ignition system of an automobile. The present invention is based on the recognition that the problems of the prior art inductive loop vehicle detectors can be overcome by sensing operation of the motors of vehicles to be detected rather than by sensing the metallic mass of the vehicle. Since licensed vehicles that travel on the highways, freeways, and city streets are motor-driven, they all have some form of electrical system to operate their electrical equipment, such as the lights, horn, windshield wipers, starter motor, etc. This requires each such vehicle to have a storage battery to operate the equipment when the vehicles' engine is not running, and since the storage battery has to be recharged, vehicles either have an alternator, generator, or a magneto. FIG. 4 shows in schematic form a generator 46 which is connected to the automobile electrical system $R_L$ and storage battery 48. During operation of the generator, a pulsating DC, or AC, current from the generator passes through the conductor leads associated with the automobile electrical system, such as a lead 50 extending from one side of the generator to the electrical load $R_L$ and to the terminal of the battery 48 through a voltage regulator 51. A return wire 52 to the generator carries current that passes through the body 53 of the automobile back to the generator. The pulsating DC current produced by the generator and travelling through the conductor leads and the body of the automobile radiates a changing magnetic flux which is detected by sensor 12. Thus, if the magnetic field produced by operation of the vehicle's motor is detected, then the vehicle itself is detected. Fortunately, the magnetic field generated by the motor is relatively weak and can only be detected within a few feet from the automobile, and therefore sensor 12 is able to separate its sensing of vehicles so as to discriminate between vehicles travelling relatively close to each other, one behind the other, or in adjacent traffic lanes.

FIG. 3 shows a schematic block diagram of a preferred system for sensing operation of a motor-driven object, such as an automobile, and for indicating that the object has been detected. Sensor 12 is shown connected to the center conductor and shield of shielded cable 36. The center conductor 34 of the shielded cable 36 is connected to the input of amplifier 54 along with the grounded cable sheathing 40 so the amplifier will amplify the relatively weak signal produced by sensor 12. The output of amplifier circuit 54 passes through an electrical filter stage 56 which filters out signals at a frequency of 60 Hz so that the sensor will not pick up stray signals generated by nearby utility lines, for example. The output from filter 56 is fed to an output amplifier 58 to drive a suitable output device such as a relay shown in FIG. 3 for providing a continuous output across terminals 62 in response to continuous energization of the output device from a changing magnetic field which induces current to flow in sensor 12 as long as the presence of a motor-drive object is being detected. Thus, when output device 60 is energized, the output can be used to trigger a suitable control device, such as traffic signal controller in control cabinet 22, in response to the operation of the motor-driven object being detected by sensor 12.

The arrangement of coil 12 as a current-generating element in the circuit shown in FIG. 3 allows the detector of this invention to continuously sense the presence of a motor-driven object independently of whether the motor-driven object is in motion so long as its motor is operating. The reason for this is that the electrical system associated with a motor generates a current having a relatively large DC component together with a relatively low-amplitude AC ripple (pulsating DC) impressed on the DC component when the motor of the vehicle is operating. Sensor 12, in the arrangement shown in FIG. 3, is able to sense the changing magnetic field generated by the AC ripple component of the current present in the electrical system of the vehicle being detected. Thus, the detector system shown in FIG. 3 is able to sense the presence of a motor-drive object whether or not the object is in motion as long as its motor is operational.

Figure 5:
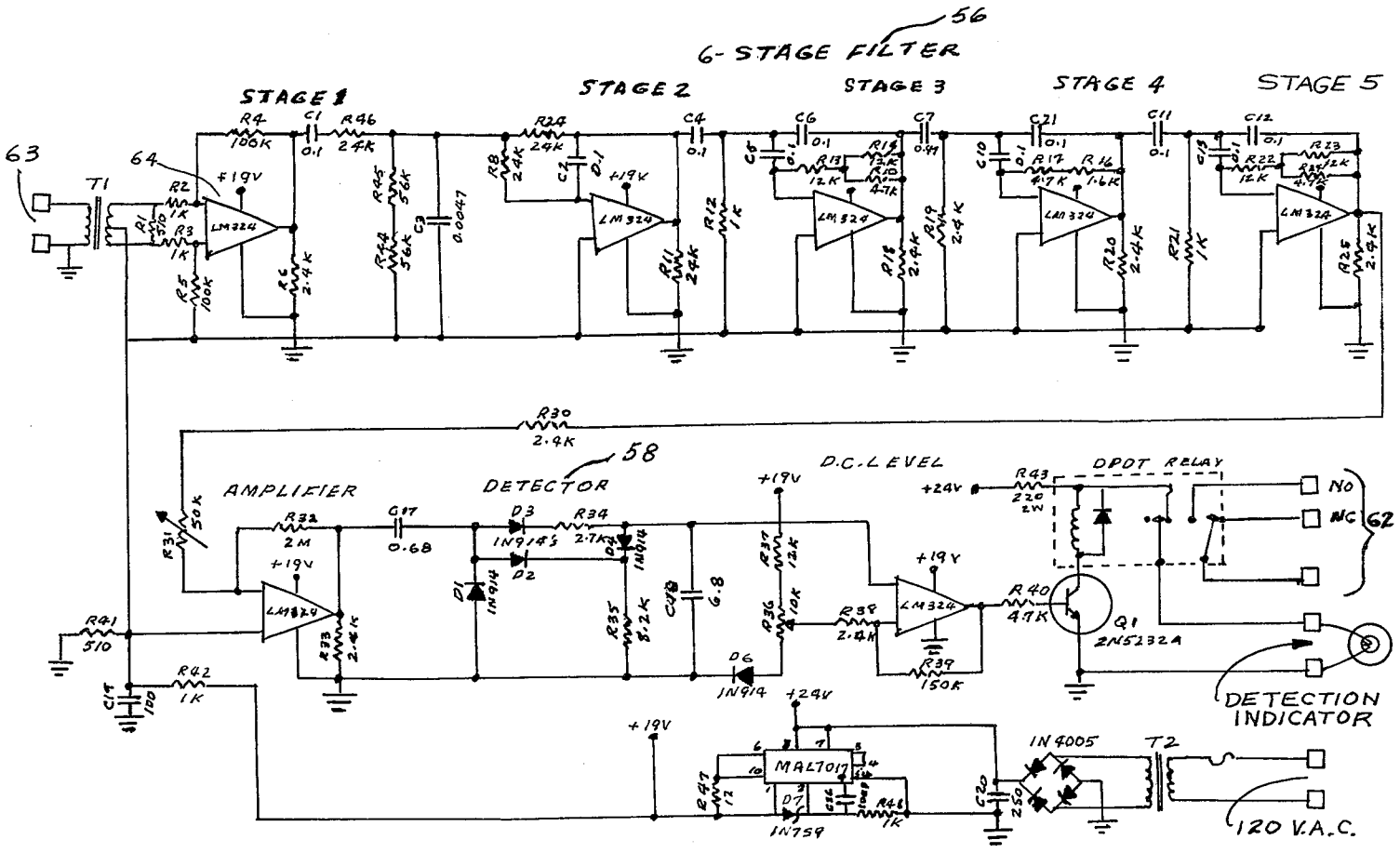
FIG. 5 is a circuit diagram for the detector, filter, amplifier and output circuit employed in the system of the present invention.

FIG. 5 is a circuit diagram of the amplifier, filter and output stages shown in FIG. 3 as 54, 56, 58 and 62. The changing magnetic field radiated by the AC ripple current or pulsating DC flowing through the wiring and body of a vehicle with its motor running such as 24 FIG. 1 radiates a pulsating magnetic field which generates a pulsating DC current in coil 28 of sensor 12 FIG. 1 while the vehicle is in close proximity of the sensor. The current generated in sensor 12 is carried by shielded cable 36 to the input of amplifier 54 being connected at 63 FIG. 5. The signal is fed through gain control potentiometer 31 FIG. 5 to the input of an amplifier stage in output circuit 58 FIG. 5. The pulsating DC or AC output of the amplifier is converted into a steady DC voltage level by the diodes and filter capacitors in the rectifier stage of output circuit 58. The DC output of the rectifier stage is fed through a DC level control potentiometer R 36 FIG. 5 to the input of the DC amplifier stage of output circuit 58 FIG. 5. The output of the DC amplifier stage controls the bias on transistor Q1 FIG. 5 turning it ON and OFF to energize and de-energize the output relay and place calls in the traffic signal controller connected to 62 when vehicles enter and leave the response area of sensor 12.

Figure 6:
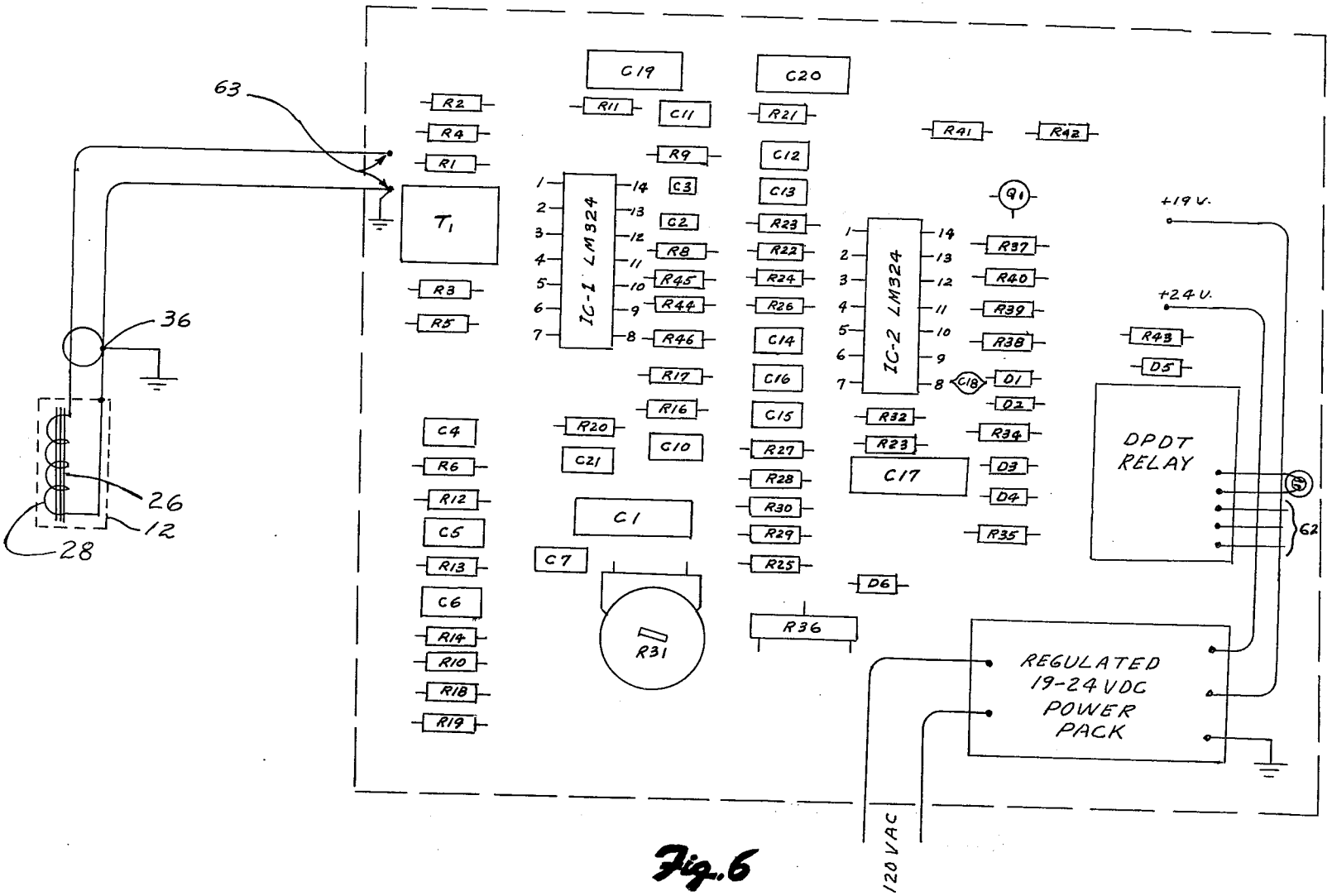
FIG. 6 is a component part layout drawing of the vehicle detector described herein with reference to FIG. 3.

FIG. 6 is the chassis layout of the electronic circuit in FIG. 5, showing location and identification of circuit components with sensor 12 connected through shielded cable 36 to 63 FIG. 6.

Figure 7:
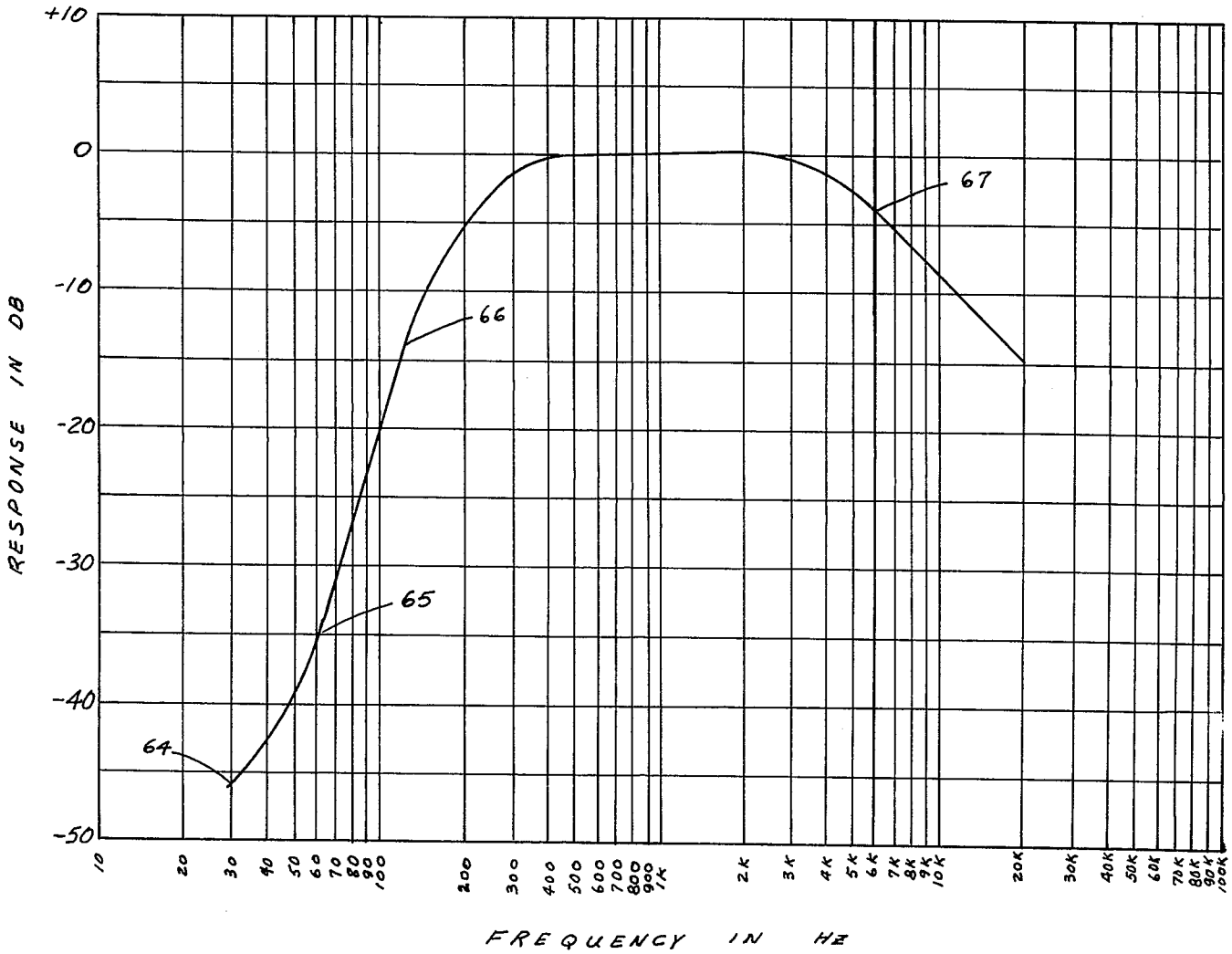
FIG. 7 is a graph illustrating the frequency response for the filter section in the system shown in FIG. 5.

FIG. 7 is a semi-log graph showing the passband of the six-stage active bandpass filter 56 FIG. 5 using resistors, capacitors and Op-Amps and showing attenuation in db at the ends of the passband. The curve shows an attenuation of −46 db of 30 Hz 64 FIG. 7, −30 db at 60 Hz 65 FIG. 7, −13 db at 120 Hz 65 FIG. 7, and $-3\frac{1}{2}$ db at 5500 Hz 67 FIG. 7.

The amplifier stage in 58 FIG. 5 is capable of 100 db gain and can be adjusted to any level using gain control R31 FIG. 5 to set the db level necessary for the output relay to respond to the desired frequencies.

EXAMPLE I

A sensor identical to that of FIG. 2 was built and connected to an amplifier through a shielded cable. The output of the amplifier was connected to a loudspeaker. When the sensor was placed on the pavement underneath an automobile having its engine running, a loud audible note with a frequency the same as the frequency of the changing magnetic field produced by the current generated by the vehicle's alternator came from the speaker. As the sensor was withdrawn from under the automobile, the sound from the speaker grew weaker and disappeared approximately three feet in front of the vehicle, indicating that the sensor could be used to detect the presence of objects, such as automobiles, travelling across the sensor placed on the roadway.

The engine speed of the automobile was increased, and the frequency of the audio tone increased proportionally. Subsequent tests revealed that the frequency of the magnetic field generated by the alternator changed from approximately 400 Hz at engine idle speed to just over 5,000 Hz at maximum rpm. The loudspeaker was replaced with a relay circuit as an output device to register a contact closure when the presence of a vehicle over the sensor was detected.

EXAMPLE II

Tests to show whether or not the sensor was effective in detecting all vehicles from the largest diesel trucks and buses to the smallest motorcycle used on the public streets and highways were made. Diesel buses, having a large alternator, could be picked up approximately 6 feet from the engine in the rear, and detection seemed to carry all the way to the front of the bus. The smallest motorcycle permitted on the streets also could be detected approximately five feet away on all sides.

EXAMPLE III

The positive battery cable was removed from the battery of the automobile described in Example I above to test the pickup when the vehicle's generator or alternator is only supplying ignition and accessory current. In this instance, the drop in output from the loudspeaker was barely detectable by ear. However, the battery on the automobile was fully charged at the time of the test.

EXAMPLE IV

Moving detection tests were made by taping sensor 12 described in FIG. 2 to the pavement and driving over it with a vehicle at speeds from 5 mph to 35 mph. In these tests the detection was excellent. The vehicle presence was detected when it reached a point approximately three feet from the pickup, and the detection was continuous as the engine portion of the vehicle passed over the pickup, and ceased at a point just prior to the rear wheels passing over the pickup.

EXAMPLE V

Tests were made with two sensors connected in series to one shielded cable. The sensors were spaced three feet apart and taped with the inner sensor 3 feet from the centerline of the street to simulate being centered on a 12foot lane. The detection was the same as it had been with one sensor, and adjacent traffic lane rejection was still excellent.

EXAMPLE VI

The sensors used in the above examples were wound to a moderately high impedance, approximately 650 ohms, and the sensor was found to be insensitive to the length of the shielded cable connecting it to the amplifier. The resistance and capacitance per foot of the shielded cable used (RG-174U coaxial cable) is small enough that extremely long lengths of cable (perhaps up to several miles in length) could be used between the sensor and the amplifier without attenuation becoming appreciable. The detector circuit amplifier is insensitive to environmental changes because it operates in the low frequency range without delicately tuned, resonant frequency oscillators. The sensor also was placed under an inch of a.c. pavement with no noticeable change in detector output when a vehicle was driven over it.

In other applications of the present invention, it is believed possible to analyze the analog output of the sensor of this invention with a computer or special electronic comparator and identify the characteristic output produced by vehicle at other detector stations along a roadway for use in traffic flow studies. The speed of a vehicle could be determined by analyzing the signal frequency as it approaches and passes the sensor. Moreover, in Example V above, connecting two pickups in series to one cable did not seem to change the output of the sensor when either or both sensors were active, which indicates many geometric configurations can be used in special detector applications, such as presence detection over a desired length of a traffic lane, detection of more than one lane of traffic using multiple sensors attached to a single cable, detection for volume occupancy calculation, or for speed calculation, and the like.

Thus, the present invention provides a sensor in which the problems of detecting small metallic objects, such as small motorcycles, are eliminated. A further advantage over inductive loop detectors is that the sensitivity to cable length between the sensor and amplifier is eliminated, as is the problem of cross-talk between adjacent sensing coils and their connecting cables, and to the problems of sensitivity of the system operation to environmental changes. Furthermore, the sensor of this invention, being relatively simple in construction and relatively small in size, reduces substantially the installation costs of the unit when compared with the costs of installing inductive loop detectors. Moreover, the present sensor does not detect a vehicle with its engine shut off, thereby eliminating locked up detectors when a vehicle is parked on top of, or close to sensors installed in the pavement.

Thus, the present invention has been described in the context of a vehicle traffic detection system, although it will be readily understood that the invention can be used in a variety of other systems responsive to the presence of a motor-driven object, such as garage door openers, parking lot gate openers, vehicle alarms, and the like, without departing from the scope of the invention.

What is claimed is:

1. Apparatus for indicating the nonmoving presence of motor-driven objects and the like comprising:

means for coupling to the changing magnetic field radiated by the flow of pulsating D.C. or A.C. ripple current supplied to the electrical system of a motor-driven object by a rotational electrical generating device contained in the electrical system of and driven by the motor of the motor-driven object;

said coupling means comprising a coil of small diameter copper wire wound on a laminated, ferrite iron core connected through an electrical connection to the input of a signal developing means to continuously detect the presence of motor-driven objects in close proximity to said coupling means independently of whether the motor-driven object being sensed is in motion;

said signal developing means comprising a system of mid-raange filter means, operational amplifier means, a rectifier means and an indicating means all coupled in sequence; whereby A.C. current of a frequency the same as the frequency of the changing magnetic field radiated by the ripple current is induced in the windings of said coupling means and fed through said signal developing means which removes electrical energy of undesirable frequencies induced in said coupling means and passes only those in the range of frequencies of ripple current generated in the electrical systems of motor-driven objects to actuate said indicating means to continuously indicate the presence of a motor-driven object in close proximity to the sensing means so long as the motor is running and the electrical generating device is operational.

2. Apparatus according to claim 1 in which the coupling means senses alternating magnetic fields in the frequency range of about 90 Hz to about 6,000 Hz.

3. Apparatus according to claim 2 in which the signal circuit includes a filter for eliminating signals below about 90 Hz and above 6000 Hz that may be sensed by the coupling means.

4. Apparatus according to claim 3 in which the ends of the coil are connected to a shielded cable having a shield and a center conductor, the cable having the shield grounded and the center conductor providing an input to said sensor circuit.

5. Apparatus according to claim 4 in which the coupling means is disposed in a traffic lane to detect motor-driven objects in the lane while in close proximity to the coupling means, the coupling means through filter, amplifier and signal development circuits of the detection means actuates an output device which can be connected to the input of a traffic signal controller installed in a cabinet adjacent to the roadway;

the traffic signal controller, being responsive to the actuation of the detection output device, actuates the trafic signals in response to motor-driven objects being sensed.

6. Apparatus according to claim 5 in which the signal developing means includes a low frequency amplifier in the 90 Hz to 6,000 Hz range coupled through a filter system to the coupling means for generating the signal developing means output to be fed to the traffic signal controller.

7. Apparatus according to claim 6 in which the coupling means includes a core of ferrite material, and in which the coil includes a multiplicity of turns of relatively fine conductor wire wound around the core.

8. Apparatus according to claim 7 including a shield wrapped around the coupling means to shield the sensor from radio frequency pickup.

9. Apparatus according to claim 8 in which the coupling means further includes a shielded conductor wire with the shield connected to one end of the inductive coil and the center conductor connected to the opposite end for transmitting induced signals to the input of the signaling developing means.

10. Apparatus according to claim 4 in which the coupling means includes a core of ferrite material, and in which the coil includes a multiplicity of turns of relatively fine conductor wire wound around the core.

11. Apparatus according to claim 10 including a shield wrapped around the sensing means to shield the sensor from radio frequency pickup.

12. Apparatus according to claim 11 in which the signal development means input is connected to the coupling means by a shielded cable, the signal developing means producing the output indicating that the motor-driven object has been sensed.

* * * * *